US006361447B1

(12) United States Patent
Lindstrom

(10) Patent No.: US 6,361,447 B1
(45) Date of Patent: Mar. 26, 2002

(54) BOWLER'S DUAL POSITION WRIST AND FINGER CONTROL DEVICE

(76) Inventor: Terry Lindstrom, 232 S. Portage St., Westfield, NY (US) 14787

( * ) Notice: Subject to any disclaimer, the term of this patent is extended or adjusted under 35 U.S.C. 154(b) by 0 days.

(21) Appl. No.: 09/457,278

(22) Filed: Dec. 8, 1999

Related U.S. Application Data

(63) Continuation-in-part of application No. 08/901,009, filed on Jul. 28, 1997, now abandoned, which is a continuation-in-part of application No. 08/782,961, filed on Jan. 13, 1997, now abandoned.

(51) Int. Cl.[7] ..... A63B 69/00

(52) U.S. Cl. ..... 473/62; 473/61; 2/162; 2/161.1; 482/45; 602/16; 602/21

(58) Field of Search ..... 473/59, 61, 62, 473/63; 482/44, 45, 46, 47, 49, 50; 2/16, 20, 159, 160, 161.1, 162, 163, 170; 602/5, 16, 21

(56) References Cited

U.S. PATENT DOCUMENTS 4,608,720 A * 9/1986 Purin
4,618,147 A * 10/1986 Hurd et al.
4,666,158 A * 5/1987 Moro
5,324,251 A * 6/1994 Watson
5,466,192 A * 11/1995 Castolo et al.

* cited by examiner

*Primary Examiner*—William M. Pierce

(57) ABSTRACT

A bowler's dual position wrist and finger control device is disclosed. The device comprises a hand plate and a forearm plate pivotally linked by a double position hinge mechanism. The double position hinge mechanism angularly disposes the hand plate and forearm plate to each other and limits any backward angular movement beyond this limit, thereby restricting the backward movement of a bowler's hand during delivery of a bowling ball. The double position hinge mechanism allows the user to pre-select two such angles of disposition and limitation in the same plane, and to chose between them by positioning a release lever up or down. The invention further discloses the use of finger supports secured to the hand plate to provide additional support for the bowler. In the preferred embodiment the finger supports are laterally pivotable about the hand plate to enable the user to adjust the supports to a comfortable position.

12 Claims, 8 Drawing Sheets

BOWLER'S DUAL POSITION WRIST AND FINGER CONTROL DEVICE

This is a continuation-in-part application of application Ser. No. 08/901,009 filed on Jul. 28, 1997 now abandoned; itself a continuation-in-part application of application Ser. No. 08/782,961 filed on Jan. 13, 1997 now abandoned. Applicant hereby claims entitlement to the filing dates of the parent applications for all subject matter common to them. Applicant acknowledges his duty to bring to the attention of the Patent and Trademark Office any information he knows to be material to the patentabilty of the information added since the parent cases were filed.

BACKGROUND OF THE INVENTION:

1. Field of the Invention

This invention relates to a wrist and finger control device for bowling, specifically to a device which supports the wrist and fingers of a bowler to optimize their position during delivery of the bowling ball. This invention also relates to a wrist and finger control device which has a multi-stage function that allows the device to be quickly alternated between two selected angular positions.

2. Description of the Prior Art

In the well-known game of bowling, the bowler's aim is to roll a ball down a lane in an effort to knock over a triangular array of ten pins. The game is divided into ten frames, in each of which (except the tenth, or last, frame which is a special case) the bowler has only two chances to knock down the entire array. The first shot in each frame, the "strike" shot, is always the same. The bowler is faced with a full ten-pin array, and the goal of the first shot in each frame is thus always the same, namely, to deliver the ball into the "pocket" of the pin array with good "action" in the hope that all the pins will fall. If the bowler is successful in causing all the pins to fall in the first shot, a strike is recorded. Since the first shot in each frame is always the same, the bowler strives for consistency.

If the bowler fails to knock down all ten pins in the strike shot, one more shot, the "spare" shot, is allowed to try to knock down any remaining pins. If the bowler is successful in doing so on this shot, a spare is recorded. Unlike the unchanging strike shot, spare shots in bowling vary widely, depending upon which pin or pins are left after the strike shot. Consequently, the bowler cannot simply plan on making the same, repeatable shot each time, but rather must have the ability to deliver the ball to different locations on the lane. Additionally, since spare shots typically only involve one pin, or a few pins, there is much less need to have mixing action on the ball to knock the pins over.

It can thus be seen that there is a fundamental distinction between the strike shot and the spare shot in bowling. It has long been understood by most good bowlers that the preferred way to execute the strike shot is by having the ball "hook" into the pocket. In other words, rather than simply throw the ball in a straight line from the point of release to the pocket, the bowler imparts rotary motion to the ball which causes the ball to follow a curved path from the point of release into the pocket. The preferred rotary motion is not easy to achieve and is imparted by the two middle fingers of the throwing hand after the thumb has been released from the bowling ball. Unlike a strike shot, however, in making a spare shot a bowler may well prefer to throw a straight ball, or one with very little hook.

Various devices have been proposed to assist the bowler in achieving the desired rotation on the ball to maximize the chance for strikes. Some of these are listed in Shaffer, et al., U.S. Pat. No. 4,371,163, a patent which also contains a good description of the general problem to which the present invention is addressed. The Shaffer patent notes that the ability of a bowler to impart the desired rotation to a ball to achieve hooking action is improved when the bowler's backward hand movement during delivery is restricted with respect to the axis of the bowler's forearm, and where the backward movement of the bowler's index finger is restricted with respect to the axis of the bowler's hand. This is called a "cupped" position of the hand. Given that bowling balls can weigh up to sixteen (16) pounds, it is easy to see that it may be difficult for a bowler to maintain the desired angular relationships of a cupped position in the absence of a means of support.

The Shaffer patent, while a significant advance over previous devices aimed at assisting bowlers, nevertheless falls short in several respects. First, the Shaffer patent, while recognizing the importance of maintaining a cupped hand and finger position in delivering the strike shot in a frame, fails to give due consideration to the fact that spare shots, being straighter shots, require a different wrist and finger position for optimal performance. Typically, the bowler will prefer a more "open" position for the hand and fingers on the spare shot, i.e., one in which there is a smaller angle, or no angle (neutral), between the hand and the longitudinal axis of the forearm, or even a "negative" angle in which the wrist extends backward beyond the forearm axis. If so, then a bowler will not want a device which restricts the backward movement of the hand to the same angle as is desirable on the strike shot, because such could interfere with the spare shot which the bowler is attempting to make. Although discussed primarily as a one-piece unit establishing a fixed angle between the forearm and hand, the description of the preferred embodiment in the Shaffer patent does describe the possibility of using an adjustable locking joint at the wrist which could theoretically be used to vary the hand and forefinger angles between shots. As a practical matter, doing so would be highly inconvenient and time-consuming, as well as introducing the possibility of error when such angular adjustments are being repeatedly made. Second, the Shaffer patent, while recognizing the importance of support for the index finger, fails to recognize the additional importance of providing support for the middle and ring fingers of the bowler's hand.

Another patent which shows a device for assisting bowlers is Castolo, U.S. Pat. No. 5,466,192. Castolo discloses a moveable bowling wrist device with four major parts, a hand portion, a forearm portion, a wing type structure to join them, and an adjustable stopping mechanism. The Castolo device allows the backward motion of the hand portion to be stopped at a certain position while the forward motion of the hand is unrestricted in the delivery. The stopping point is adjustable. The hand portion and forearm portion can also be positioned with respect to each other on a horizontal plane by a swiveling action, and then locked into place.

Although the Castolo patent recognizes the significant difference between cupped and uncupped hand positions for bowling, it does not recognize the corresponding importance of providing a device which can be conveniently moved between two positions for optimum performance on different types of shot. In particular, Castolo does not disclose a stopping mechanism capable of simultaneously incorporating two backward stopping points which can be selectively alternated by the bowler without the need to readjust or recalibrate. Castolo also fails to disclose a device which provides support to the three longest fingers of the bowler's hand.

It can thus be seen that there is a need for a device which will provide the optimal support and control for a bowler in both of the shot situations which will be encountered by the bowler, strike shots and spare shots, and which can easily and accurately be changed from one position to another depending upon the shot. There is additionally the need for a device which will provide support for the three fingers of the bowler which are used in the delivery of the ball.

SUMMARY OF THE INVENTION

Accordingly, several objects and advantages of the present invention are:

a. To provide a wrist and finger support device which assists in maintaining the correct angular relationship between the bowler's forearm, hands and fingers, thereby enabling the bowler to impart desired motion while delivering a bowling ball;

b. To provide such a device which is adjustable over a range of angles and which can be used by different sized bowlers;

c. To provide such a device with a dual stage quick release automatic return hinge system or "smart hinge," which can be quickly changed between two preselected angle settings by means of a release lever so that the bowler can quickly and accurately change settings from a strike (cupped) shot position to a spare (open) shot position;

d. To provide support for the index and middle two fingers of the bowler's delivery hand for additional control and to enhance the bowler's ability to impart the desired motion to the bowling ball;

e. To provide individual support for the middle two fingers and the index finger of the bowler's delivery hand which are independently, laterally adjustable over a range of angles such that the middle two fingers of the bowler will be supported at the precise lateral displacement preferred by the bowler, as will the index finger.

Other objects will be apparent from the reference to the ensuing description, and it is to be understood that the invention is not limited to the particular embodiments as shown in the accompanying drawings, and other constructions are possible within the scope and spirit of the appended claims.

DESCRIPTION OF THE PREFERRED EMBODIMENT

An overall view of the invention is best viewed by beginning with FIG. 19 which shows an exploded view of the entire invention. The preferred embodiment is built around two platforms, hand plate 10 and forearm plate 11.

Figure 4:
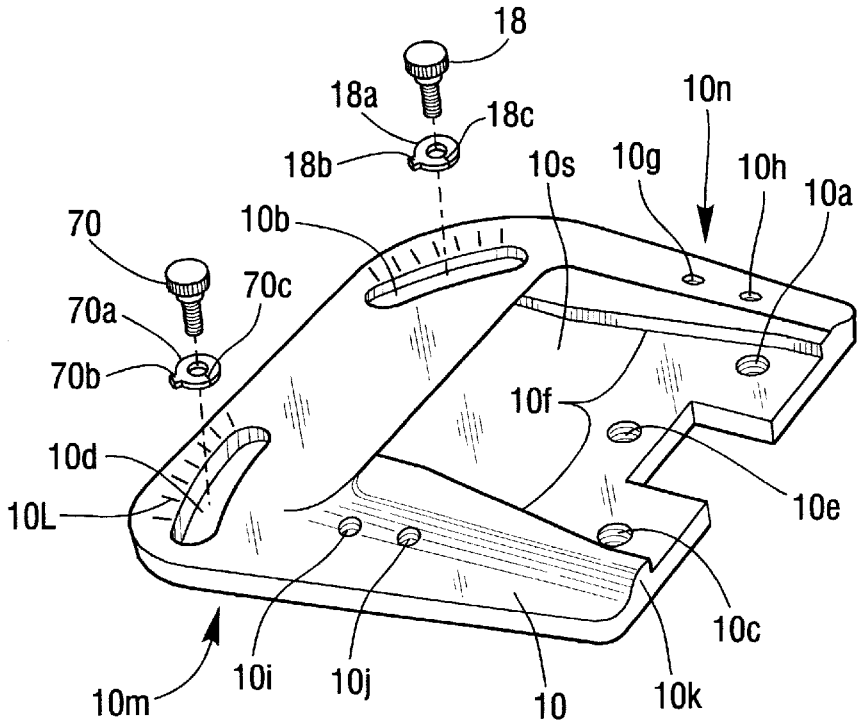
FIG. 4 is an exploded view of the hand plate and two thumbscrews with two cursor washers.

Hand plate 10 is best shown in FIG. 4. It is a flat plate made of a strong, rigid material, for example stainless steel or aluminum, with a ventral side lOm shaped in a generally cylindrical way so as to conform with the area at the back of the bowler's hand from approximately the wrist joint to the base of the fingers. Hand plate 10 includes tapped holes 10*a*, 10*c*, 10*e*, 10*g*, 10*h*, 10*i*, and 10*j* and two slots, right arc-shaped slot 10*b* and left arc-shaped slot 10*d*. Scribed lines 10*l* about the arc-shaped slots 10*b*, 10*d* provide reference marks whose use will become clear later. The dorsal side 10*n* of hand plate 10 is shaped to include a pair of raised ribs 10*k*, parallel to each other and thereby forming a pair of dove-tailed slots 10*f*, and a sliding surface 10*s*, as best seen in FIG. 4.

Figure 7:
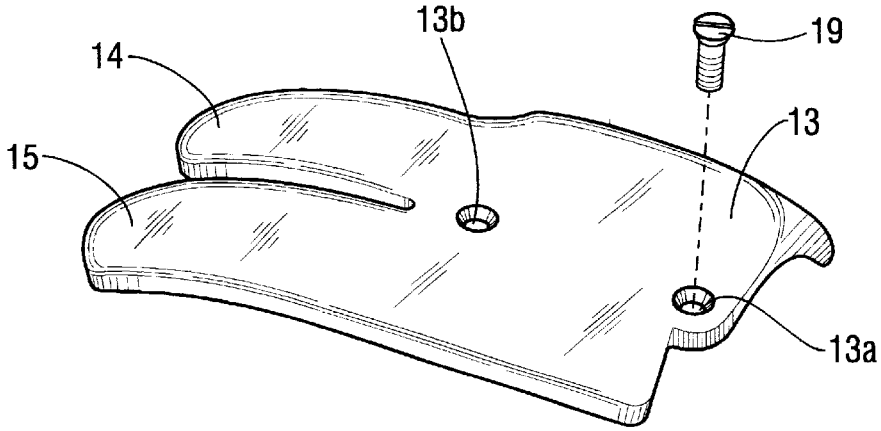
FIG. 7 is a perspective view of the middle-ring finger support.

A number of other component parts of the invention are attached to hand plate 10. One of the attached component parts is middle-ring finger support 13, as best seen in FIG. 7. It is shaped to conform comfortably to the two fingers and back of the user's hand, and the ventral side 10*m* of hand plate 10. In the preferred embodiment, middle-ring finger support 13 is made of a resilient and strong, but flexible material, such as nylon, to both provide positive support and a "springing" action to assist in delivery of the ball. Middle-ring finger support 13 includes middle finger extension 15 and ring finger extension 14 which extend beyond the edge of hand plate 10 and support the bowler's fingers. Tapped hole 13*b* is located near the center of middle-ring finger support 13, and hole 13*a* is near the end opposite finger extensions 14 and 15.

Figure 12:
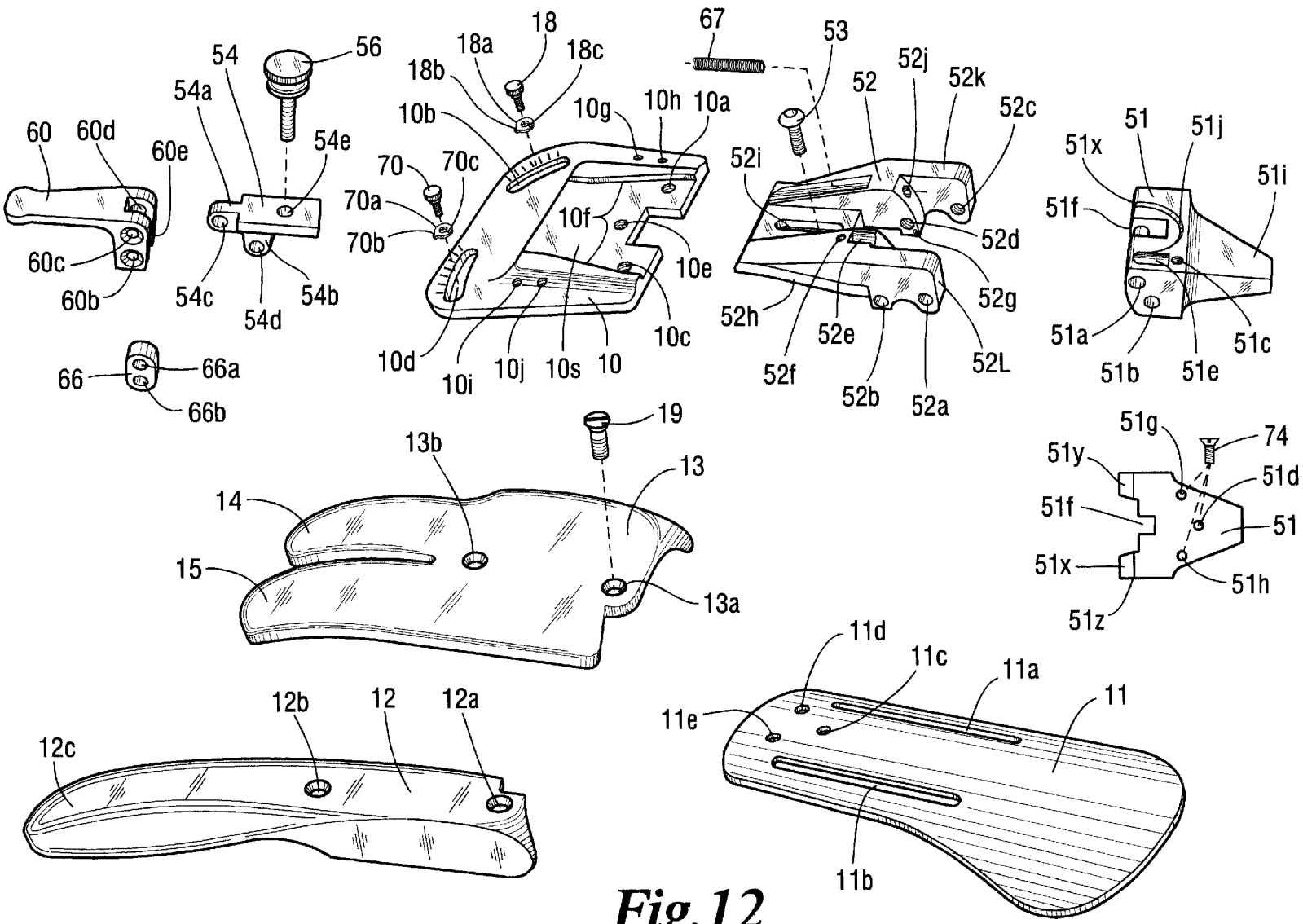
FIG. 12 is an exploded view of the entire invention.

As best seen in FIG. 12, the middle-ring finger support 13 attaches to the ventral side 10*m* of hand plate 10 by means of pivot bolt 19 passing through hole 13*a* and into tapped hole 10*a*. From the dorsal side 10*n* of hand plate 10, thumbscrew 18 passes through cursor washer 18*a*, right arc-shaped slot 10*b* and into tapped hole 13*b*. The cursor washer 18*a* includes a scribed reference line 18*c* and a tab 18*b* which fits snugly within right arc-shaped slot 10*b*. It can thus be seen that when thumbscrew 18 is loosened, the middle-ring finger support 13 can be laterally pivoted about pivot bolt 19, thereby varying the angle between the finger extensions 14, 15 and hand plate 10. When the desired lateral angle of displacement is obtained, thumbscrew 18 can be tightened and middle-ring finger extension 13 will be locked firmly in place. Reference line 18*c* can be compared with scribed lines 10*l* on hand plate 10 to measure the angle of displacement.

Figure 8:
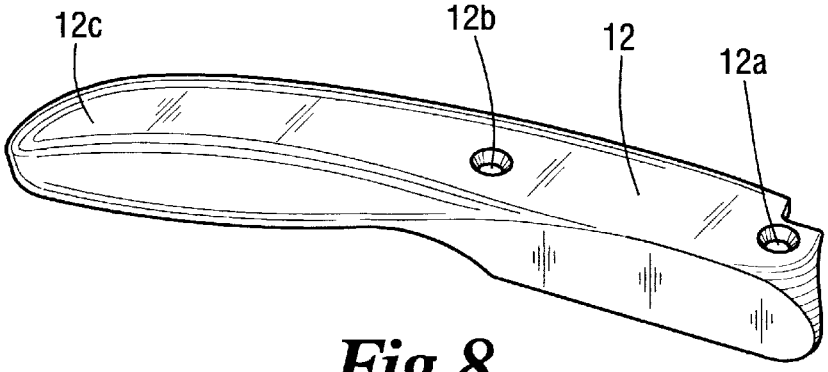
FIG. 8 is a perspective view of the index finger support.
Figure 9:
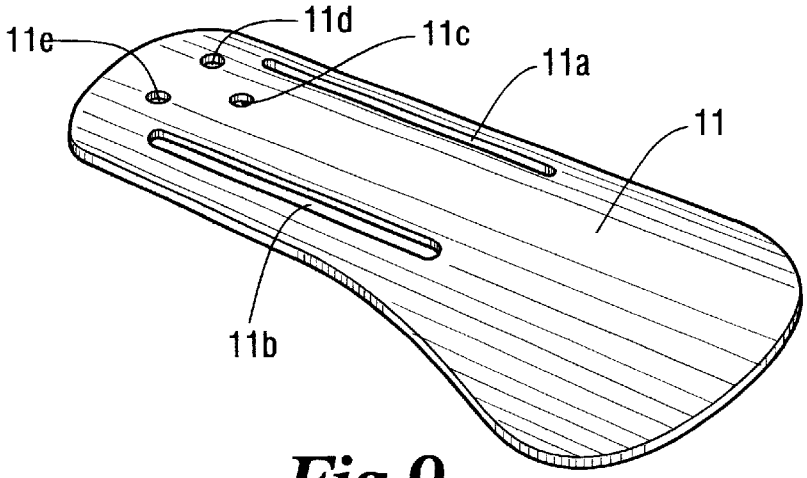
FIG. 9 is a perspective view of the forearm plate.

Index finger support 12 seen in FIG. 8, is similarly attached to hand plate 10. Index finger support 12 is made of the same type of material as middle-ring finger support 13, and includes a single index finger extension 12*c*, hole 12*a* and tapped hole 12*b*. As seen in FIG. 12, index finger support 12 is attached to the ventral side 10*m* of hand plate 10 in the same manner as middle-ring finger support 13. Pivot bolt 19 passes through hole 12*a* and into tapped hole 10*c* of hand plate 10. Thumbscrew 70 passes through cursor washer 70*a*, left arc-shaped slot 10*d*, and into tapped hole 12*b*. It can thus be seen that index finger support 12 can be angularly adjusted in the lateral plane in the same manner, but independent of, middle-ring finger support 13.

Although the preferred embodiment of the invention thus includes two separate, laterally adjustable support members for the fingers, it should be apparent that other variations are also possible. For instance, support for the fingers could be provided by a single member, or by three separate members, and the lateral adjustment mechanism could be discarded in either single or multiple member embodiments.

Figure 1:
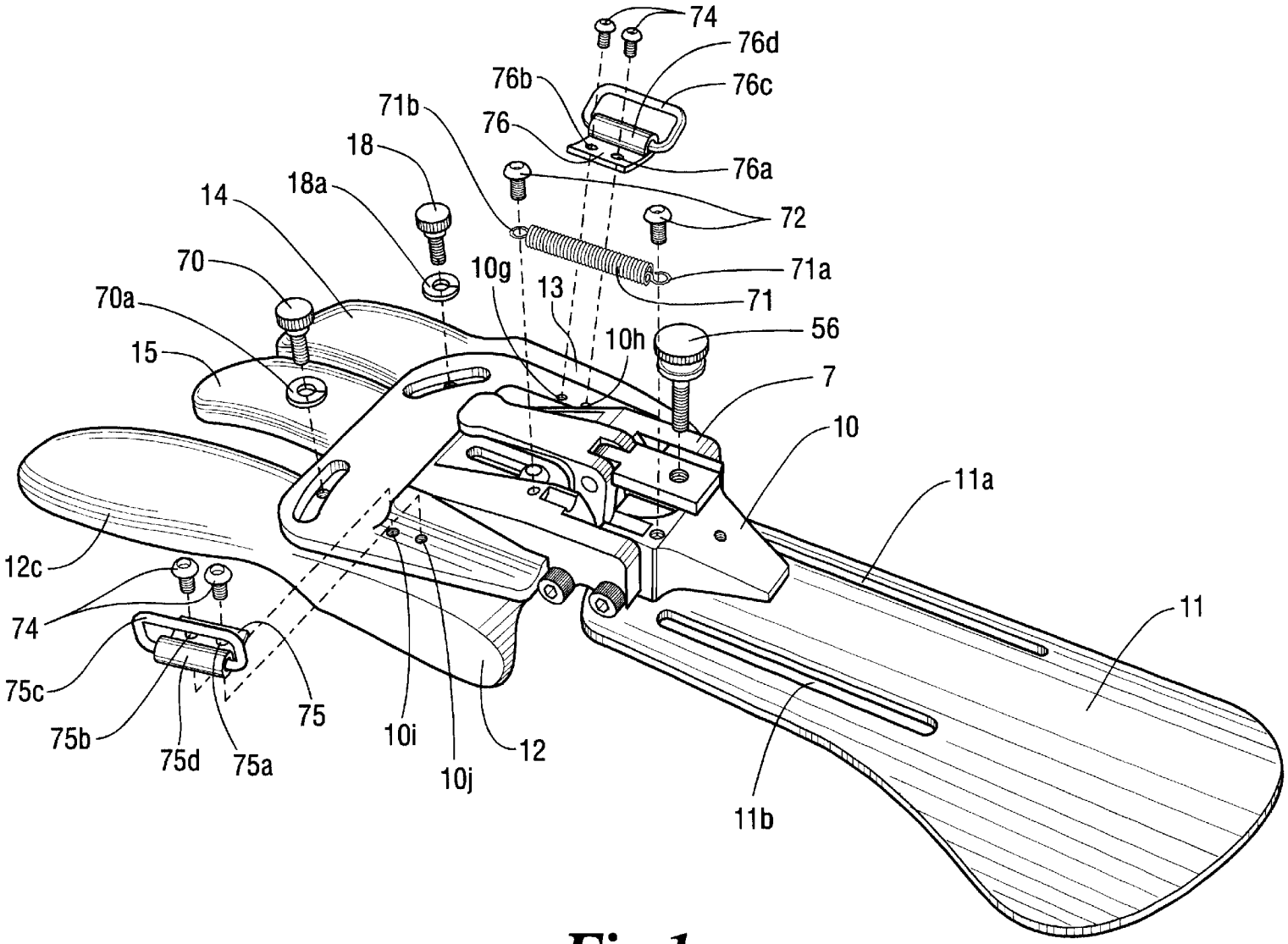
FIG. 1 is a perspective view of the invention in a nearly assembled state which also shows an exploded view of some of the parts.

Hand plate 10 is secured to the user's hand by conventional strap means. Palm strap anchors 75, 76 are secured to the hand plate 10 by screws 74. See FIG. 1. The palm strap anchors 75 and 76 are identical, although separate part numbers have been given for the sake of clarity. Referring to palm strap anchor 75 in FIG. 1, it can be seen that it has holes 75*a* and 75*b*. Curled end 75*d* secures a rectangular ring 75*c*. The palm anchor 75 is affixed to the hand plate 10 by means of screws 74 passing through holes 75*a*, 75*b* and into the tapped holes 10*i*, 10*j* of the hand plate 10. A conventional strap (not shown) running between the two palm straps anchors 75, 76 secures this part of the device to the user's palm.

Reference is next made to FIG. 16 and the forearm plate 11. It is a substantially flat plate made of a strong, rigid material, such as stainless steel or aluminum, and constructed so that its ventral side 11*g* curves in a generally cylindrical fashion around the user's forearm and wrist area. Forearm plate 11, with a wrist end 11*f*, includes slots 11*a*, 11*b* running parallel with its cylindrical axis. These slots 11*a*, 11*b* provide a point for the attachment of conventional strapping means (not shown) used to secure the forearm plate 11 to the user's forearm. Forearm plate 11 further includes three holes, 11*c*, 11*d*, 11*e* near the wrist end 11*f*, and their use will be described later.

Figure 2:
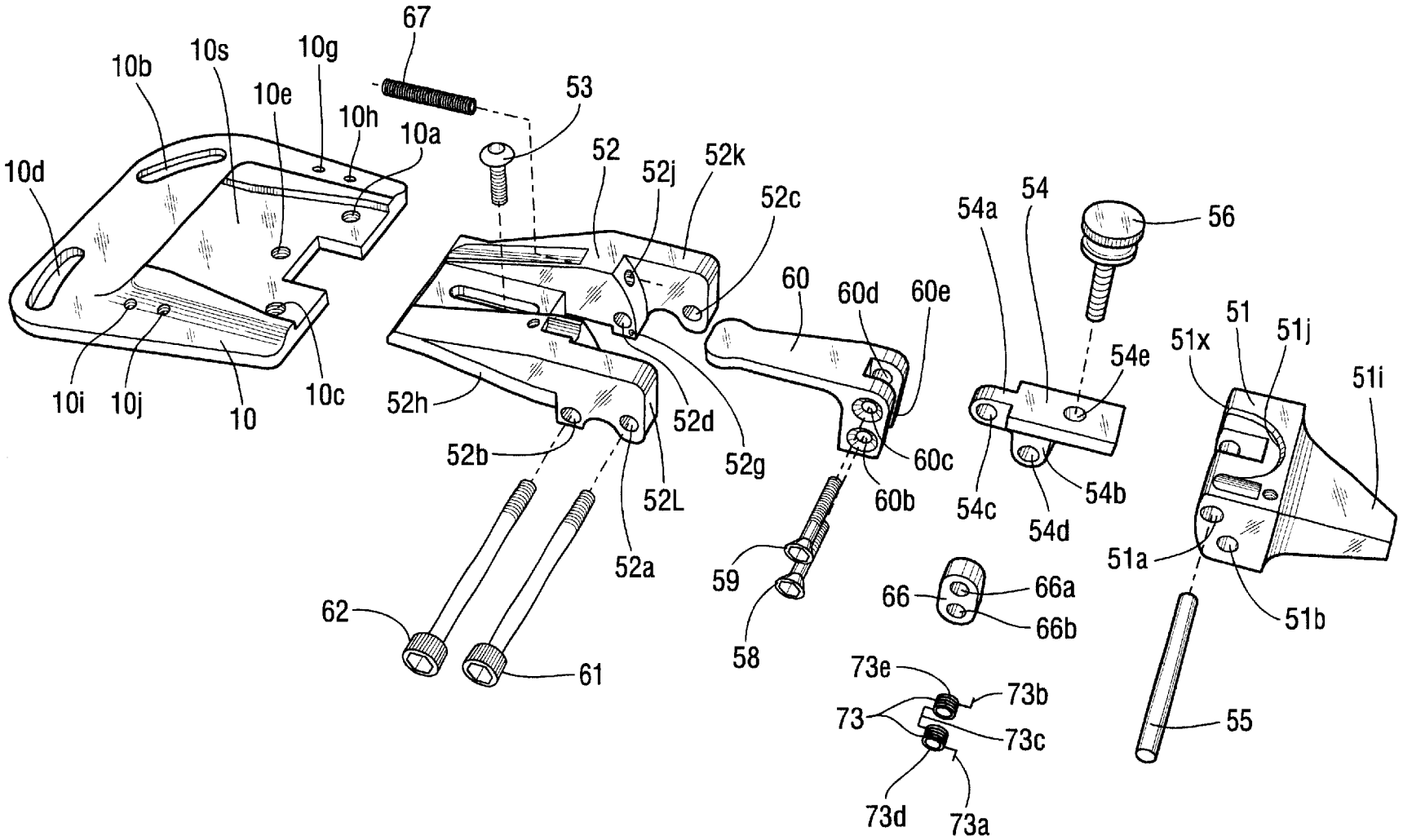
FIG. 2 is an exploded view of the components of the dual stage quick release automatic return hinge, or smart hinge, mechanism.

A dual stage quick release automatic return hinge, or smart hinge, mechanism, shown generally as 50 in FIG. 2, which is one of the key features of the invention, joins the hand plate 10 and forearm plate 11, and further provides the mechanism for allowing the device to be quickly moved from a strike, or cupped, position to a spare, or open, position. The major components of the smart hinge mechanism are a hinge arm 52, hinge base anvil 51, and release lever assembly (see FIG. 10).

Figure 5:
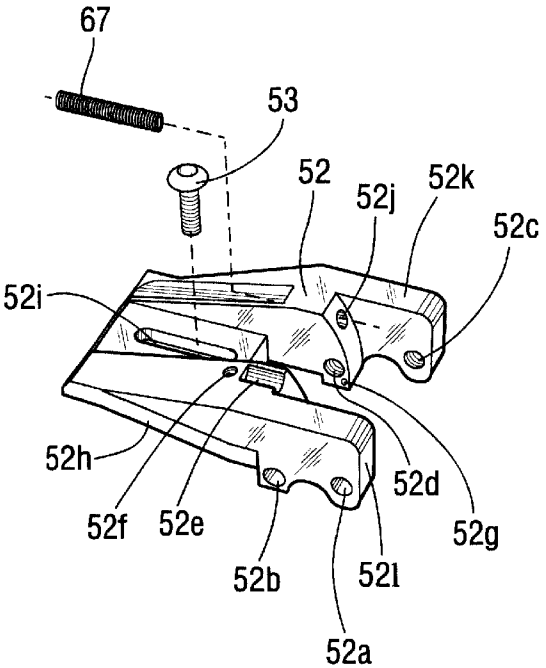
FIG. 5 is an exploded view of the hinge arm, the secondary adjustment screw and the hinge arm locking screw.

Referring first to FIG. 2, the hinge arm 52 can be seen. Hinge arm 52 includes a dove-tailed slide section 52*h* which is dimensioned and shaped to fit snugly into the dove-tailed slots 10*f* of the hand plate 10 so that it can be slidably disposed along sliding surface 10*s*. Adjustment slot 52*i* allows the hinge arm 52 to be moved in or out with respect to sliding surface 10*s*, and then secured in the desired position by tightening lock bolt 53 which threads into tapped hole 10*e* of the hand plate 10. Hinge arm 52 forks into two lugs, 52*l*, 52*k*. Lug 52*l* includes through bores 52*a* and 52*b*. Lug 52*k* includes corresponding tapped holes 52*c* and 52*d* directly opposite through bores 52*a* and 52*b*, as best seen in FIG. 5. Retainer holes 52*g* in lug 52*k* and 52*m* in lug 52*l* are used to retain a spring, as will be described later. Adjustment bore 52*j* is a tapped hole extending through the hinge arm 52 adjacent to lug 52*k* and parallel thereto. A hollow 52*n* is cut into the hinge arm 52 to accommodate secondary adjustment screw 67 which can be threaded into adjustment bore 52*j*. Finally, tapped hole 52*f* and spring hollow 52*e* provide the means to secure return spring 71, which is described further below.

Figure 3:
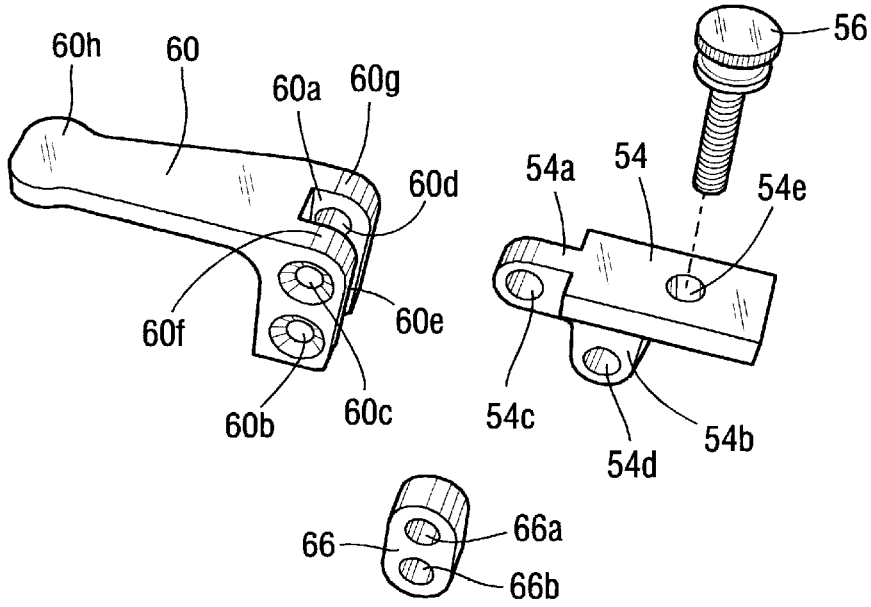
FIG. 3 is an exploded view of the release lever, the over-center arm, the adjustable fulcrum arm, and the primary adjustment screw.
Figure 6A:
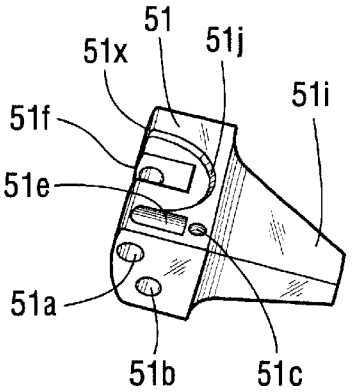
FIG. 6 is a perspective view of the hinge base anvil (FIG. 6*a*), and the bottom view of the hinge base anvil (FIG. 6*b*).
Figure 6B:
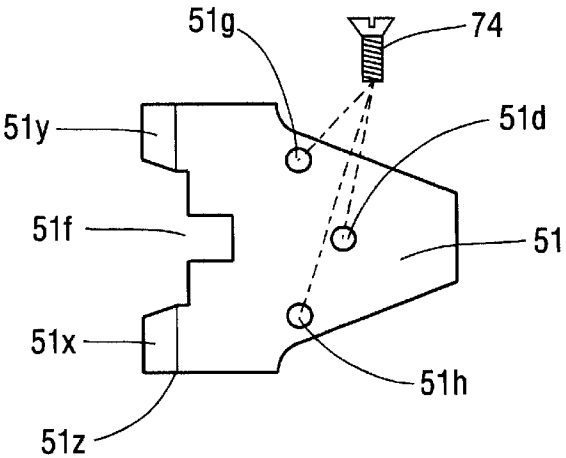

The other base component of the smart hinge 50 is the hinge base anvil 51, as best seen in FIGS. 3 and 6. Hinge base anvil 51 is secured to forearm plate 11 by three screws 74. Tapped holes 51*d*, 51*g*, and 51*h* in the bottom of hinge base anvil 51, see FIG. 6*b*, correspond with holes 11*c*, 11*d* and 11*e* on the forearm plate 11 for that purpose. The hinge base anvil 51 is generally fork shaped, with a tail section 51*i* and a forward section 51*k* forking into lugs 51*y* and 51*z*. Lugs 51*y* and 51*z* are dimensioned to be received between and within lugs 52*l* and 52*k* of the hinge arm 52. The two lugs 51*y*, 51*z* define a slot 51*f*. Upper through bore 51*a* and lower through bore 51*b* pass through lugs 51*x* and 51*y*. The hinge base anvil 51 further includes a first bearing surface 51*j* and a second bearing surface 51*x*. Spring hollow 51*e* corresponds with spring hollow 52*e*, and tapped hole 51*l* with tapped hole 52*f*. When the hinge arm 52 and hinge base anvil 51 are mated, hinge base anvil 51 is pivotally linked to hinge arm 52 by means of pivot bolt 61 which passes through through bore 52*a* in lug 52*l* of the hinge arm 52, through lower through bores 51*b* of the hinge base anvil 51, and then threads into tapped hole 52*c* of lug 52*k*.

The pivotability between hinge arm 52 and hinge base anvil 51 (and therefore between hand plate 10 and forearm plate 11), is controlled in a number of ways. Secondary adjustment screw 67 is threaded through tapped hole 52*j* and it strikes against bearing surface 51*x* on hinge base anvil 51. This serves to put a limit on how far the smart hinge 50 can be opened. The further secondary adjustment screw 67 is threaded into tapped hole 52*j*, the more of it protrudes and the more restricted is the limit on how far the smart hinge 50 can be opened.

The other way in which the smart hinge 50 is controlled is through its third major component, the release lever assembly, as best seen in FIGS. 2 and 3. The release lever assembly consists of three major parts, a fulcrum arm 54, a release lever 60, and an over center arm 66.

Fulcrum arm 54 is somewhat t-shaped. The vertical portion of the "t" is shown as tab 54*b* which includes through bore 54*d*. The horizontal portion of the "t" includes leverage tab 54*a*, with through bore 54*c*, which runs parallel to through bore 54*d*. Tabs 54*a* and 54*b* are co-planar and at right angles. The opposing end of the cross portion of the "t" has tapped hole 54*e*.

Release lever 60 is a contoured, 1-shaped lever which has a forked end 60*i* and a thumb handle end 60*h*. The forked end 60*i* includes opposing tangs 60*f* and 60*g*, best seen in FIG. 10. Tang 60*f* has two through bores, bottom through bore 60*b* and top through bore 60*c*, and tang 63*g* has two corresponding tapped holes, bottom tapped hole 60*e* and top tapped hole 60*d*. The space between tangs 60*f* and 60*g* is a slot 60*a*.

The over center arm 66 is a simple piece with two through bores 66*a* and 66*b*. It is of a thickness to allow it to fit snugly within slot 60*a* of release lever 60.

Now that the major components of the release lever mechanism have been described, the means by which they are interconnected with each other, and incorporated into the smart hinge 50, can be explained. Fulcrum arm tab 54*b* is placed into slot 51*f* of hinge base anvil 51, thereby aligning through bore 54*d* of fulcrum arm 54 with upper through bore 51*a* of hinge base anvil 51. Pivot pin 55 passes through these bores 51*a*, 54*d*, thereby pivotally securing fulcrum arm 54 to hinge base anvil 51. When thus in position, pivot pin 55 is restricted from lateral movement by the proximity of hinge arms lugs 52*k*, 52*l*, between which the hinge base anvil 51 has been placed.

Primary adjustment thumbscrew 56 threads into tapped hole 54*e* of fulcrum arm 54. When turned clockwise primary adjustment thumbscrew 56 strikes against bearing surface 51*j* of the hinge base anvil 51. The primary adjustment thumbscrew 56 provides the means for setting angular positions for the smart hinge 50, as will be explained in more detail below.

Tab 54*a* of fulcrum arm 54 is inserted into slot 60*a* of release lever 60, thereby aligning through bore 54*c* with through bore 60*c* and tapped hole 60*d*. Pivot bolt 59 then pivotally secures the fulcrum arm 54 to the release lever 60.

The over center arm 66 is placed into slot 60*a* below fulcrum arm 54, with through bore 66*a* aligned with through bore 60*b* and tapped hole 60*e* of the release lever 60. Pivot bolt 58 pivotally secures this end of the over center arm 66 to the release lever 60.

The other end of over center arm 66 is positioned so that through bore 66*b* comes into alignment with through bore 52*b* and tapped hole 52*d* of the hinge arm 52. An offset retention spring 73, with an offset surrounded by two coils 73*d*, 73*e* is placed around over center arm 66, also in alignment with through bore 66*b*. Pivot bolt 62 can then pass into through bore 52*b*, through coil 73*d*, through through bore 66*b*, through coil 73*e*, and into tapped hole 52*d*, thereby providing a further point of pivotal attachment. Retaining tabs 73*a*, 73*b* on the ends of offset retention spring 73 are inserted into retainer holes 52*g* and 52*m* thereby securing the retention spring 73. Return spring 71 fits within spring hollow 52*e* and 51*e*, and is secured in place by screws 72 through the end coils 71*a*, 71*b* of the return spring 71 and threaded into tapped holes 52*f* and 51*l*.

Now that the construction of the smart hinge 50 has been described, its use can be better appreciated. There are three forms of adjustment allowed by the design. First, the primary adjustment screw 56 is used to set two distinct positions, one for a cupped position and one for an open position.

At this point, it will be useful to once again explain these terms. If a bowler's arm is held straight out, palm up, so that the arm and hand are in a straight line, that would represent a neutral position. As the hand is rotated at the wrist joint, above the straight line, there would be an increasingly positive angle; as the hand is rotated at the wrist joint below the straight line, there would be an increasingly negative angle. Cupped and open are relative terms, with the cupped position representing a more positive angle than the open position, although the actual value of the angles can vary. For instance, +35 °/0°, or 0°/−25° both represent cupped/open angle pairs, although 0° is the open position in the first instance and the cupped position in the second.

Returning to the preferred embodiment, the primary adjustment screw 56 is used only for changing the angles of the positions, and not for changing from one position to another. The ratio of the cupped position angle to the open position angle is a constant, so that, for example, moving the cupped position angle one way moves the open position angle the same direction. The ratio between the positions depends on the geometry of the smart hinge 50 and can be easily changed by varying the size of parts, particularly the length of the over center arm 66. Applicant has determined that a ratio of 7°:5° works well, and the preferred embodiment employs that ratio. The following chart shows some examples of resulting positions:

| Cupped | Open |
|---|---|
| +35° | 0° |
| +20° | −5° |
| +21° | −10° |
| +14° | −15° |
| +7° | −20° |
| 0° | −25° |

(Note that this chart assumes secondary adjustment screw 67 is not used to limit the open position).

Second, release lever 60 provides the means for switching from a cupped position into an open position, by either raising the release lever which changes the device from a cupped position to an open position, or by lowering the release lever, which changes an open position to a cupped position.

Third, the secondary adjustment screw 67 sets a limit on the amount of open position, thereby effectively allowing some variation in the otherwise fixed ratio between the cupped and open positions which would otherwise result. In other words, the secondary adjustment screw 67 is used to interrupt the fixed ratio by limiting the open position. As the secondary adjustment screw 67 is turned clockwise, it strikes against bearing surface 51*x* of hinge base anvil 51 and stops any further breaking backward motion of hinge arm 52. Therefore, the secondary adjustment screw 67 can limit the amount of open position, but cannot increase the amount of open position provided by the primary adjustment screw 56.

Figures 10, 10A, 10B, 10C:
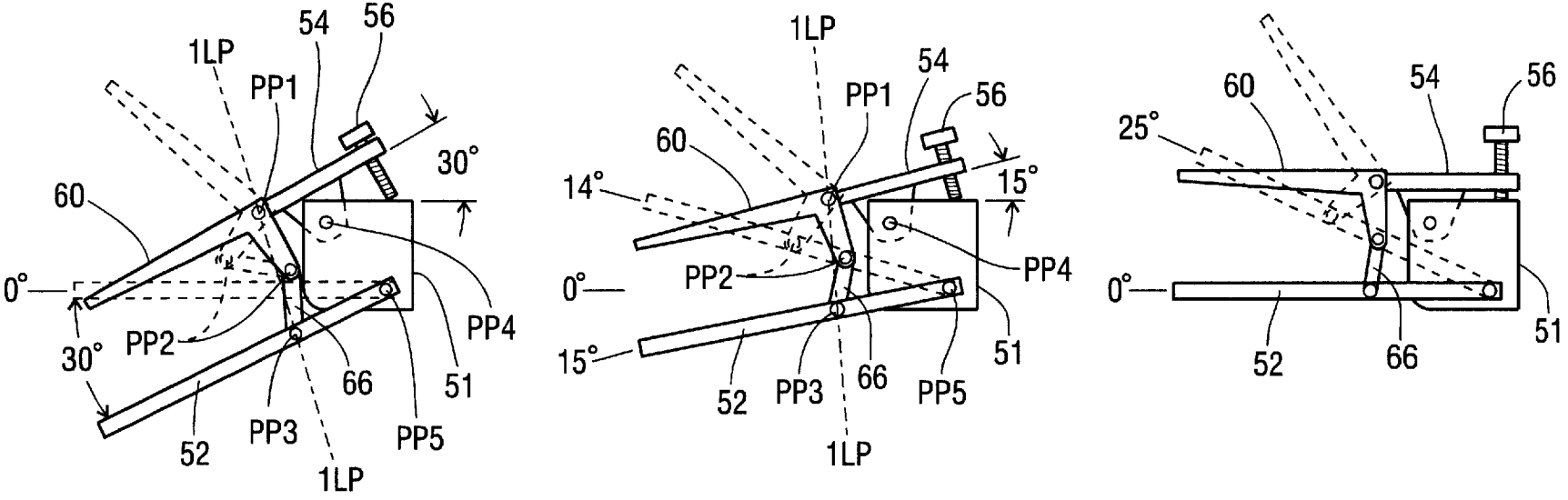
FIGS. 10 (10*a*, 10*b*, 10*c*) is a simplified diagram showing the smart hinge and the ratio between a cupped position and an open position within a specified angular range, and also showing how the transformation between a cupped and an open position is achieved through the use of the release lever, using three different settings of the primary adjustment screw.
Figure 11:
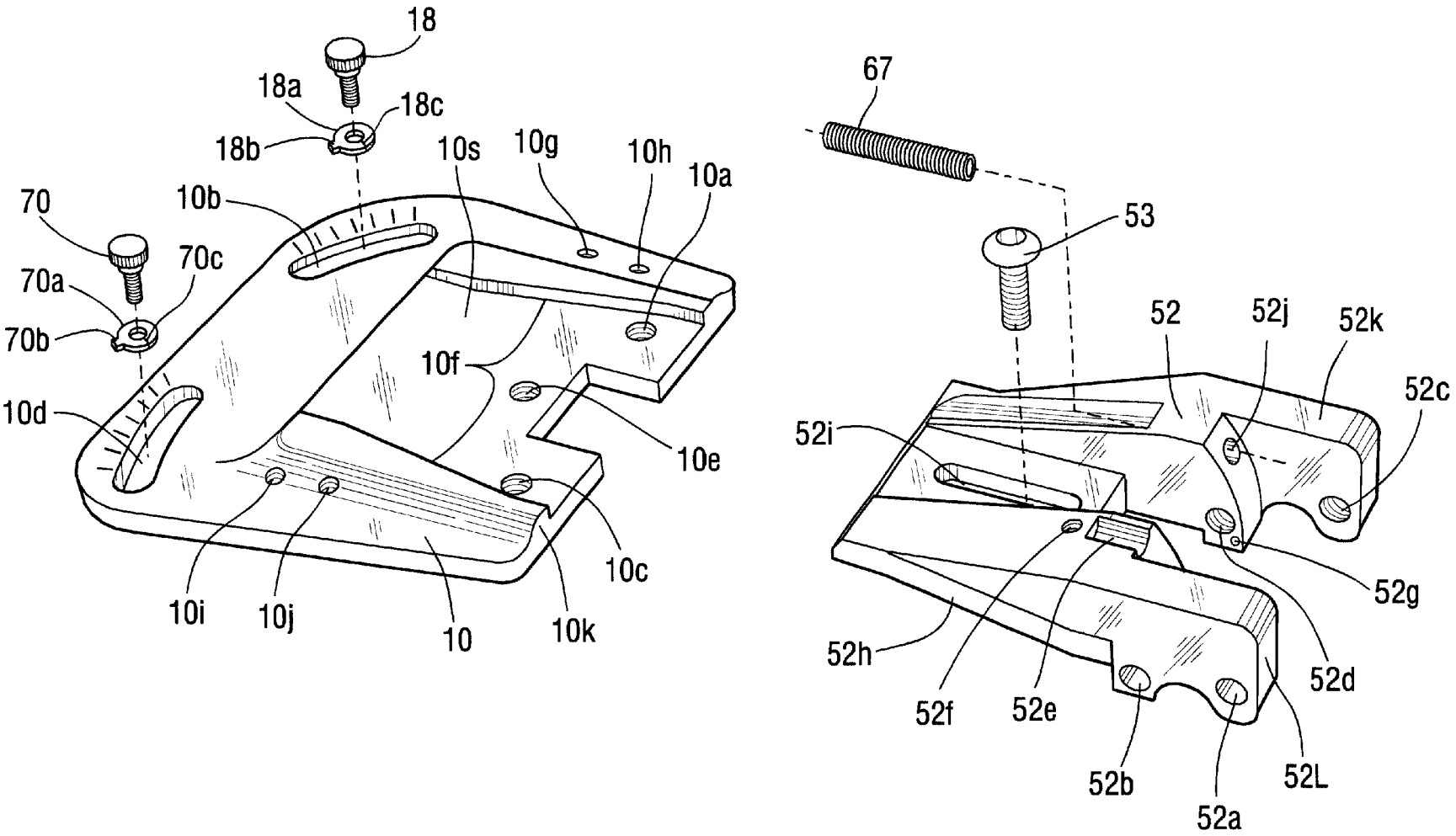
FIG. 11 is a perspective view showing some of the major parts of the invention.

The operation of the smart hinge 50 can best be seen in FIG. 10. This is a series of diagrams simplified to depict the smart hinge 50 and the ratio between a cupped position and an open position within a specified angular range. FIG. 10 also shows how the transformation between a cupped and an open position is achieved through the use of the release lever 60. FIGS. 10*a*, 10*b* and 10*c* show how the angles can be changed by varying primary adjustment screw 56. It must be kept in mind that FIGS. 10*a*, 10*b* and 10*c* represent simplified lever arrangements which attempt to show how the positional changes are accomplished through various articulations between the hinge members. The angular displacements shown are only for purposes of explaining the functions of the smart hinge 50, and are not intended to limit the invention since it is apparent that various angles and ratios can be achieved within the scope and spirit of the invention by changing the size or position of the component parts.

The first thing to note about FIG. 10 is how it shows the five pivot points of the invention, as follows:

PP1—about pivot bolt 59

PP2—about pivot bolt 58

PP3—about pivot bolt 62

PP4—about pivot pin 55

PP5—about pivot bolt 61

FIG. 10*a* shows that a cupped angle of 35 degrees has been set, in this case representing a fully cupped position, as defined by the solid line form of the drawing. The corresponding divided line form represents the open position, shown to be at zero degrees or neutral, meaning that hinge arm 52 is in straight line with hinge base anvil 51. Achieving an angle is accomplished by turning primary adjustment screw 56 clockwise, which contacts hinge base anvil 51 and forces fulcrum arm 54 to be angularly disposed to hinge base anvil 51 by raising one end of fulcrum arm 54 and lowering the other end due to the pivotal link, PP4, between the fulcrum arm 54 and hinge base anvil 51. Release lever 60 is pivotally linked to the fulcrum arm 54 at PP1, and pivotally linked to the over center arm 66 at PP2. The other end of the over center arm 66 is pivotally linked to hinge arm 52 at PP3. Finally, hinge arm 52 is pivotally linked to hinge base anvil 51 at PP5.

The articulation between the fulcrum arm 54, over center arm 66, and hinge arm 52 produces a knee-type hinge, with the knee being at PP2. When the release lever 60 is in a lowered position, the knee at PP2 is locked, or breaking past its in-line position of PP1, PP2 and PP3, as shown by line ILP on the drawing, but limited in over centering due to its construction which prevents the knee at PP2 from overextending, with retention spring 73 helping to keep the knee joint in position. As a result, a cupped position of 35° is produced. When release lever 60 is raised, the knee at PP2 bends, or is disengaged, which allows hinge arm 52 to collapse, reducing the angle from 35° to 0°, or neutral.

In FIG. 10*b,* the primary adjustment screw 56 has been turned counterclockwise, which reduces the angle between the fulcrum arm 54 and the hinge base anvil 51. As a result, the hinge arm 52 angle is reduced to 15°, with the angle of the fulcrum arm 54 and the angle of the hinge arm 52 staying proportionate as the angle is reduced. When release lever 60 is raised, the knee at PP2 is disengaged and the angle between the fulcrum arm 54 and the hinge arm 52 changes. As shown in FIG. 17*b,* the movement of adjustment screw 56 has thus changed the cupped angle to a positive 15° and the open position to a negative 10°.

In FIG. 10*c,* the primary adjustment screw 56 has been turned fully counterclockwise and the cupped angle of the fulcrum arm 54 and the hinge arm 52 is further reduced to a neutral position. When the release lever 60 is disengaged, the hinge arm 52 is then positioned at an open position of negative 25 degrees, with a cupped position at zero degrees, or a neutral position. Therefore a maximum cupped position at 35° will produce an open position at a neutral position, 0°, when the release lever 60 is disengaged (FIG. 10*a*), and a minimum cupped position at 0° will produce an open position of −25° when the release lever 60 is disengaged (FIG. 10*c*). Thus, the ratio between a cupped position and an open position remains constant throughout the full angular range of motion of the smart hinge 50. The secondary adjustment screw 67, not shown in FIG. 10, allows this otherwise constant ratio to be interrupted on the open position by limiting the open position angle (i.e., by narrowing the angular range between cupped and open positions that would otherwise result in the absence of this secondary adjustment). Thus, for example, the secondary adjustment screw 67 might be used to limit the open position to 10° with a 35° fully-cupped position. This feature greatly increases the user's ability to customize the two angle positions "programmed" into the smart hinge 50.

While the smart hinge 50 is a complex arrangement of levers and pivotal links, it simplifies the process of changing positions by making the transformation easy, accurate and reliable and eliminating the guesswork element associated with other hinge systems.

It will be apparent from the foregoing description that many modifications or variations of the invention can be made without

PARTS LIST

| DESCRIPTION | PART NO. |
|---|---|
| Hand Plate | 10 |
| Tapped Hole | 10a, 10c, 10e, 10g, 10h, 10i, 10j |
| Right Arc-Shaped Slot | 10b |
| Left Arc-Shaped Slot | 10d |
| Dove-Tailed Slots | 10f |
| Raised Ribs | 10k |
| Scribed Lines | 10l |
| Ventral Side | 10m |
| Dorsal Side | 10n |
| Sliding Surface | 10s |
| Forearm Plate | 11 |
| Wrist Strap Anchor Slots | 11a, 11b |
| Holes | 11c, 11d & 11e |
| Wrist End | 11f |
| Ventral Side | 11g |
| Index Finger Support | 12 |
| Bore | 12a |
| Hole | 12a |
| Tapped Hole | 12b |
| Index Finger Extension | 12c |
| Middle-Ring Finger Support | 13 |
| Bore | 13a |
| Tapped Hole | 13b |
| Ring Finger Extension | 14 |
| Middle Finger Extension | 15 |
| Thumb Screw | 18 |
| Cursor Washer | 18a |
| Tab | 18b |
| Reference Line | 18c |
| Pivot Bolt | 19 |
| Double-Position Hinge Mechanism | 50 |
| Hinged Base Anvil | 51 |
| Upper Through Bore | 51a |
| Lower Through Bore | 51b |
| Through Bore | 51b |
| Tapped Holes | 51d, 51g & 51h |
| Lug | 51e |
| Slot | 51f |
| Tail Section | 51i |
| First Bearing Surface | 51j |
| Forward Section | 51k |
| Tapped Hole | 51l |
| Second Bearing Surface | 51x |
| Lug | 51y, 51z |
| Hinge Arm | 52 |
| Through Bores | 52a, 52b |
| Tapped Holes | 52c, 52d |
| Spring Hollow | 52e |
| Tapped Hole | 52f |
| Retainer Hole | 52g, 52m |
| Dove-tailed Slide Section | 52h |
| Adjustment Slot | 52i |
| Tapped Hole | 52j |
| Lugs | 52l, 52k |
| Hollow | 52n |
| Lock Bolt | 53 |
| Fulcrum Arm | 54 |
| Leverage Tab | 54a |
| Fulcrum Arm Tap | 54b |
| Through Bore | 54d |
| Through Bore | 54e |
| Tapped Hole | 54e |
| Pivot Pin | 55 |
| Primary Adjustment Screw | 56 |
| Pivot Bolt | 58 |
| Release Lever | 60 |
| Slot | 60a |
| Bottom Through Bore | 60b |
| Top Through Bore | 60c |
| Top Tapped Hole | 60d |
| Bottom Tapped Hole | 60e |
| Tangs | 60f, 60g |

-continued

PARTS LIST

| DESCRIPTION | PART NO. |
|---|---|
| Thumb Handle End | 60h |
| Forked End | 60i |
| Pivot Bolt | 61 |
| Pivot Bolt | 62 |
| Over Center Arm | 66 |
| Bore | 66a |
| Through Bore | 66b |
| Secondary Adjustment Screw | 67 |
| Thumb Screw | 70 |
| Cursor Washer | 70a |
| Return Spring | 71 |
| End Coils | 71a, 71b |
| Screws | 72 |
| Retention Spring | 73 |
| Retaining Tabs | 73a, 73b |
| Wire Tab | 73c |
| Coil | 73d, 73e |
| Screws | 74 |
| Palms Strap Anchors | 75, 76 |
| Holes | 75a, 75b |
| Rectangular Ring | 75c |
| Curled End | 75d |

substantially departing from the essential concept as set forth herein. Since many changes can be made in the above description, and many apparently widely varying embodiments of the invention could be made without departing from the scope thereof, it is intended that all matter contained in the drawing and specifications shall be construed as illustrative and not in a limiting sense.

What is claimed is:

1. A bowler's multi-stage wrist, hand and finger control device, comprising:

(a) a hand plate with a ventral surface adapted to conform with a back of a bowler's hand and a dorsal surface;

(b) a forearm plate with a ventral surface adapted to conform with a bowler's forearm and a dorsal surface;

(c) a dual stage quick release automatic return hinge system which includes a hinge arm attached to the dorsal surface of the hand plate, a hinge base anvil attached to the dorsal surface of the forearm plate, and a release lever pivotally linking the hinge arm and the hinge base anvil such that the dual stage quick release automatic return hinge angularly disposes the hand plate and the forearm plate to each other at one or the other of two angles in a plane generally perpendicular to the dorsal surfaces of the hand plate and forearm plate depending on the corresponding position of the release lever.

2. The bowler's multi-stage wrist, hand and finger control device as recited in claim 1, further including one or more finger support members generally conforming to a bowler's fingers, fastened to the ventral surface of the hand plate and extending therefrom.

3. The bowler's multi-stage wrist, hand and finger control device as recited in claim 2 wherein the one or more finger support members are pivotally fastened to the ventral surface of the hand plate such that they may be laterally pivoted with respect to said ventral surface, and further comprising locking means to secure said one or more finger support members at a desired lateral position.

4. The bowler's multi-stage wrist, hand and finger control device of claim 2, further including a first securing means to secure the hand plate to a bowler's hand and second securing means to secure the forearm plates to a bowler's forearm.

5. The bowler's multi-stage wrist, hand and finger control device as recited in claim 2, wherein the hinge arm includes a dove-tailed slide section slidably received into corresponding dove-tailed slots in the dorsal surface of the hand plate.

6. A bowler's multi-stage wrist, hand and finger control device, comprising:

(a) a rigid hand plate of aluminum or other suitable material, adapted to conform with a back of a bowler's hand and extending approximately from a wrist joint to a base of the fingers, and a dove-tailed slot to provide an adjustable slide feature for adjustably attaching the rigid hand plate to a hinge arm;

(b) a rigid forearm plate of aluminum or other suitable material, adapted to conform with a bowler's forearm and sized to extend from approximately a wrist joint at a back of a bowler's hand toward a bowler's elbow, having a forward end oriented toward the wrist joint, and having two parallel slots running parallel with the bowler's forearm to provide an anchor for a strap, and also providing through bores for attachment of a hinge base anvil at the forward end of the rigid forearm plate; and (c) dual stage quick release automatic return hinge means for pivotally connecting the rigid hand plate and the rigid forearm plate and allowing them to be precisely and repeatably angularly disposed to each other at variable angles throughout a normal range of a typical wrist joint, and also being designed to define this disposition into two positions, a first position being a cupped position and a second position being an open position, such that the device can be set at a home position for both a cupped position and an open position through the use of a primary adjustment screw and then switched back and forth between the two home positions through the use of a release lever which provides a quick, accurate and reliable transformation between the two positions.

7. A bowler's multi-stage wrist, hand and finger control device, as recited in claim 6, further including a first finger support adjustably attached to the rigid hand plate, the first finger support conforming to a surface of the rigid hand plate and including an index finger extension being generally shaped to conform to an index finger of a bowler's hand, and providing support thereto, and a second finger report conforming to a surface of the rigid hand plate and including a middle finger extension and a ring finger extension and being generally shaped to conform to a middle finger and a ring finger and with a divide between the middle finger extension and the ring finger extension to allow each finger to be supported and to function independently of the other.

8. A Bowler's multi-stage wrist, hand and finger control device, as recited in claim 6 in which the dual stage quick release automatic return hinge means comprises:

(a) a hinge base anvil securely attached to the rigid forearm plate and having two through bores, one for providing attachment of an adjustable fulcrum arm and one for attachment of a hinge arm means;

(b) a hinge arm means adjustably attached to the rigid hand plate by a dove-tailed slide section which intersects with a dove-tailed slot in the rigid hand plate, and also having a tapped hole through which a secondary adjustment screw is threaded;

(c) pivot means by which the hinge base anvil is pivotally linked to the hinge arm;

(d) adjustment means by which an angular differential of two separate positions are controlled by a primary adjustment screw;

(e) selection means for choosing between one of two previously selected angular dispositions through the use of a release lever which includes a forked end;

(f) articulation means by which the adjustable fulcrum arm, the release lever and an over center arm articulate with the hinge base and on the hinge arm to produce the ability to set two distinct positions and then switch back and forth between the two positions with reliably accurate and quick movement;

(g) release mechanism means by which the adjustable fulcrum arm is pivotally linked to the hinge base anvil through a tab on the fulcrum arm which protrudes downward and central to the fulcrum arm, and at a backward end of the adjustable fulcrum arm is a tapped hole through which the primary adjustment screw is threaded to provide adjustment and the forward end of the adjustable fulcrum arm is pivotally linked to the release lever at its forked end which also provides for and pivotally links to the over center arm at its upper end and at its lower end being pivotally linked to the hinge arm means, which in turn is pivotally linked to the hinge base anvil, whereby through this combination of levers, arms and pivot links is created a knee action hinge which supports an angle when the knee link is engaged or over centered, and the knee link is collapsed to reduce an angular position of the hinge arm, and due to this configuration of arms and levers, there is approximately a seven degree: five degree ratio from a cupped position to an open position so that for every seven degrees change in the cupped position, the open position is changed in the same direction by five degrees; and (h) secondary adjustment means by which an open position can be altered from a pre-selected position that was set using the primary adjustment screw, by using the secondary adjustment screw which is housed in the tapped hole in the hinge arm and protrudes through the hinge arm at a place where it can strike against the hinge base anvil, clockwise turn of the secondary adjustment screw, thereby decreasing an open position angle whereas a counterclockwise turn of the secondary adjustment screw will increase an open position angle to a point at which the primary adjustment screw assumes control of the functions.

9. A bowler's multi-stage wrist, hand and finger control device, comprising:

(a) a hand plate cast or machined from aluminum or other suitable material of equal strength, and adapted to conform with a back of a bowlers hand and extending from approximately a wrist joint to a base of the fingers, and with features that provide attachment ports for two resilient finger supports, also having two curved slots for adjustably attaching the two resilient finger supports, further being fitted with a dove tailed slot section for the purpose of an adjustable attachment feature, the dove tailed slot intersects with the dove tailed tongue section of the hinge arm and provides an adjustable attachment between the hand plate and the hinge arm, and having two tapped holes one on ether side and at the backward end and toward a wrist for pivotally attaching the two resilient finger supports, further having four tapped holes, with two tapped holes positioned on either side and somewhat central and along the edge of the hand plate for the purpose of attaching two strap anchors;

(b) a forearm plate cast or machined from aluminum or other suitable material of equal strength, and adapted to conform with a bowlers forearm and sized to extend from approximately a wrist joint at a back of a users hand toward a elbow and having a forward end oriented toward a wrist joint, also having two parallel slots one on either side and oriented toward the edge of and running parallel with the forearm plate for the purpose of anchoring a wrist strap, further having three through bores arranged in a triangular formation and at a forward end toward a wrist joint for the purpose of attaching the hinge base anvil, further having two lobes one on either side and at a backward end toward a elbow and conforming to a posterior side of a forearm for the purpose of containing and prohibiting the forearm plate from slipping or kicking sideways; and (c) a dual stage quick release automatic return hinge system, or smart hinge, for pivotally connecting the hand plate and the forearm plate and allowing them to be precisely and repeatably angularly disposed to each other at variable angles throughout a normal range of a typical wrist joint, further being designed to define this angular range into two segments or stages, with a first stage representing a cupped position and a second stage representing an open position, such that a home location is set for each stage through the use of the primary adjustment screw, and then through the use of the release lever the smart hinge can shift back and forth between stage one and stage two, by depressing the release lever the smart hinge will disengage from stage one home location and position itself in stage two home location and then automatically return to stage one home location on command, this happening when a user cups their wrist and no further adjustment is necessary to activate the automatic return, the smart hinge performing these transformations between the stages with a quick, accurate and reliable movement taking only about a second.

10. A bowler's multi stage wrist, hand and finger control device as recited in claim 9 in which the smart hinge means comprises:

(a) a hinge base anvil securely attached to the forearm plate and having two through bores, one for providing attachment of an adjustable fulcrum arm means, and one for attachment of a hinge arm means, also having three tapped holes in it's bottom side and arranged in a triangular formation which matches a similar arrangement of through bores in a top side and forward end of the forearm plate and attached thereto, further having a tapped hole in it's top side and toward it's left edge and central for the purpose of attachment of a return spring;

(b) a hinge arm means for pivotally attaching the hand plate to the hinge base anvil, further providing a dove tailed slide section which intersects with a dove tailed slot in the hand plate and allowing the hinge arm and the hand plate to be adjustable along a longitudinal plane in respect to the hinge arm, which provides an adjustment feature for the length of a back of a hand, also having a tapped hole through which a secondary adjustment screw is threaded;

(c) pivot means by which the hinge arm is pivotally linked to the hinge base anvil;

(d) adjustment means by which an angular differential of two separate positions is controlled by a primary adjustment screw;

(e) selection means for choosing between one of two previously selected angular dispositions through the use of a release lever;

(f) articulation means by which the adjustable fulcrum arm, the release lever and the over center arm articulate with the hinge base anvil and the hinge arm to produce the ability to set two distinct positions or locations and then switch back and forth between the positions or locations with reliably accurate and quick movements;

(g) a release mechanism means by which an adjustable fulcrum arm being pivotally linked to the hinge base anvil through a fulcrum arm tab which protrudes downward and central to the fulcrum arm, and at its backward end is a tapped hole through which the primary adjustment screw is threaded and provides adjustment thereto, and at it's forward end being pivotally linked to the release lever at its forked end which also provides for and pivotally links to an over center arm at it's upper end, and at its lower end being pivotally linked to the hinge arm means, which in turn is pivotally linked to the hinge base anvil, whereby through this combination of levers, arms and pivotal links is a knee action hinge which supports an angle when the knee link is engaged or over centered, and the knee link is collapsed or released to reduce an angular position of the hinge arm, and due to this configuration of arms and levers there is approximately a 7:5 degree ratio from a cupped position to an open position, so every 7 degree of angular change to a cupped position results in a 5 degree angular change to a open position; and (h) a secondary adjustment means by which an open position can be altered from a pre-selected position that was set using the primary adjustment screw, by using the secondary adjustment screw which is housed in a tapped hole in the hinge arm and protrudes through the hinge arm at a place where it can strike against the hinge base anvil which restricts the hinge arm from opening, a clockwise turn of the secondary adjustment screw thereby decreases an open position angle whereas a counterclockwise turn will increase an open position angle to a point at which the primary adjustment screw assumes control of the functions.

11. The bowler's multi stage wrist, hand and finger control device as recited in claim 9 wherein a set of resilient finger supports are used for the purpose of supporting the hand and fingers, and further providing adjustment features that make it possible for a variety of different hand sizes to fit within the multi-stage wrist, hand and finger control device.

12. The bowler's multi-stage wrist, hand and finger control device as set forth in claim 11, comprising:

(a) a first resilient finger support means for providing support for a portion of a hand and an index finger, with said resilient finger support being generally shaped to conform to a back of a hand from approximately a wrist joint and covering an area of a hand to about a base of the index finger and then being contoured to the back side of the index finger and running slightly past an end of the index finger, further the index finger portion of the first resilient finger support is angled downward and toward the palm approximately 18 degrees in respect to the hand portion of the first resilient finger support, also including a tapped hole and a through bore, with a tapped hole located at a forward end and toward a base of the index finger extension of the first resilient finger support and for the purpose of adjustably attaching the first resilient finger support to the hand plate, further having a through bore located at a backward end and toward a wrist joint and for the purpose of pivotally attaching the resilient finger support to the hand plate;

(b) a second resilient finger support means for providing support for an area of a hand from about a wrist joint to about a base of a ring and middle finger where the second resilient finger support then divides into two separate finger extension members and provides support thereto, also having a tapped hole and a through bore, with a tapped hole located at a forward end and toward a base of the ring and middle finger and for the purpose of adjustably attaching the second resilient finger support to the hand plate, further having a through bore located at a backward end and toward a wrist joint and for the purpose of pivotally attaching the second resilient finger support to the hand plate;

(c) wherein said first and second resilient finger supports are made from a material such as nylon or other material that possesses the same characteristics, such as toughness, flexibility, reflex action and the ability to sustain repeated thrusts applied against it without fatigue and failure, further being able to flex under a load while maintaining support then having the ability to rebound with the same effects as experienced with a springboard, all of which are key components and are instrumental to the design of the first and second resilient finger supports; and (d) said first and second resilient finger supports further being engineered for the purpose of reducing a stress that is applied to the finger joints, while at the same time increasing an amount of lift and generating a more intense snap just prior to a release of a bowling ball.

* * * * *